US005151076A

United States Patent [19]

Strand

[11] Patent Number: 5,151,076

[45] Date of Patent: Sep. 29, 1992

[54] MANUFACTURING METHOD FOR A FLEXIBLE CONTAINER

[75] Inventor: Olaf Strand, Porsgrunn, Norway

[73] Assignee: Norsk Hydro A.S., Oslo, Norway

[21] Appl. No.: 720,846

[22] PCT Filed: Dec. 21, 1989

[86] PCT No.: PCT/NO89/00134

§ 371 Date: Jul. 11, 1991

§ 102(e) Date: Jul. 11, 1991

[87] PCT Pub. No.: WO90/06844

PCT Pub. Date: Jun. 28, 1990

[30] Foreign Application Priority Data

Dec. 21, 1988 [NO] Norway ..... 885700

[51] Int. Cl.[5] ..... B31B 1/74

[52] U.S. Cl. ..... 493/186; 493/227; 493/926; 493/933

[58] Field of Search ..... 493/186, 217, 227, 231, 493/243, 254, 267, 924, 926, 933

[56] References Cited

U.S. PATENT DOCUMENTS 3,106,140 10/1963 Baker ..... 493/217
4,191,229 3/1980 Skaadel et al. ..... 383/7
4,710,967 12/1987 Petschner ..... 383/8

*Primary Examiner*—Bruce M. Kisliuk
*Assistant Examiner*—Jack W. Lavinder
*Attorney, Agent, or Firm*—Wenderoth, Lind & Ponack

[57] ABSTRACT

A flexible container for lifting transportation and storing of bulk material is manufactured from a hose-like blank, where one half-length portion of the hose-like blank is turned inside out and threaded onto or fitted over the other half-length portion form an inner sack and an outer sack having a common base or individual abases. The hose-like blank has at a mid-length thereof two or more longitudinal slots or openings separated by the same distance around the circumference of the hose-like blank. One half-length portion is rotated with regard to the other half-length portion around a central axis of the hose-like blank, such that the material of the areas between the slots after rotation forms two or more integrated lifting loops.

7 Claims, 2 Drawing Sheets

MANUFACTURING METHOD FOR A FLEXIBLE CONTAINER

BACKGROUND OF THE INVENTION

The present invention relates to a method of manufacturing a flexible intermediate bulk container (FIBC) for lifting, transportation and storing of bulk material. The FIBC is formed from a hose-like blank. One half-length portion of the blank is turned inside out and thread onto or pulled over the other half-length portion, thus forming inner and outer sacks having a common base or separate bases.

By a flexible container as employed herein is meant a container for lifting, transportation and storing of bulk material such as powderous or granular fertilizer, ground or unground grain, Portland cement, coal, etc., in quantities of several hundred kilos per container.

There are previously known sack-like containers for the above-mentioned type. U.S. Pat. No. 3,789,897 describes a FIBC comprising inner and outer sacks which are formed from a hose-like blank where one half-length portion of the blank is turned inside out and threaded onto the other half-length portion. In the fold formed between the inner and outer sacks at the top end of the container, there is placed a rope for drawing together the filling section of the container. The same type of system is used at the base of the container.

For lifting of such container, along the circumference thereof is arranged a set of separate lifting loops each passing through slots in the inner and outer sacks below the rope. The container is therefore complicated to construct and expensive to manufacture. In addition, a draw-back of such container is that there exists considerable stress concentration in the areas where the lifting loops are attached to the inner and outer sacks. This stress can result in rupture during lifting of the container. The carrying capacity is thus limited by the construction, and is described as being between 600–1000 kg.

A second type of double-walled container is known from NO U.S. patent application Ser. No. 871,705. The main disadvantage of this container is its complicated and labor intensive manufacturing method.

SUMMARY OF THE INVENTION

The object of the present invention is to provide a method of manufacturing a flexible container, where the container construction is simplified and improved so that the manufacturing costs are reduced and that the load carrying capacity is increased two to three times without the need to increase the quality of the container material.

A special feature of the invention is that the hose-like blank of material used for the container is provided with two or more longitudinal slots or openings separated by the same distance around the circumference of the hose-like blank. One half-length portion of the hose-like blank is rotated with respect to the other half-length portion around the longitudinal axis of the blank and that one half-length portion is turned inside out and threaded onto the other half-length portion. Thus, the material in the areas between the slots or openings forms two or more integrated lifting loops.

The integrated lifting loops are extensions of the walls of the inner and outer sacks and extend in parallel from the inner sack to the outer sack. During lifting of the container according to the invention, the forces will be distributed evenly and uniformly, i.e. without stress concentrations, to the walls of the inner and outer sacks. The rotation also ensures that the material of lifting loops are rotated. The material of the lifting loops is kept together and the loops themselves extend in parallel, thus forming a single lifting eye.

By comparing the container according to the invention and the container according to the above mentioned U.S. patent, several advantages are obtained:

Containers can be made with larger carrying capacity by using the same quality of material, i.e. the ratio of carrying capacity/material weight increases.

The manufacture of flexible containers is simpler with fewer manufacturing steps and parts. In U.S. Pat. No. 3,789,897, separate lifting loops and ropes for drawing together sections at the top and bottom are employed and this requires several manufacturing steps and complicated equipment.

Lifting of the container for transportation is simplified because the loops will form only one lifting eye. During lifting of the container according to the U.S. patent, the separate lifting loops have to be hooked on the lifting means individually.

BRIEF DESCRIPTION OF THE DRAWINGS

The invention will be described in more detail below by way of examples only and with reference to the accompanying drawings in which.

DETAILED DESCRIPTION OF THE INVENTION

Figure 1:
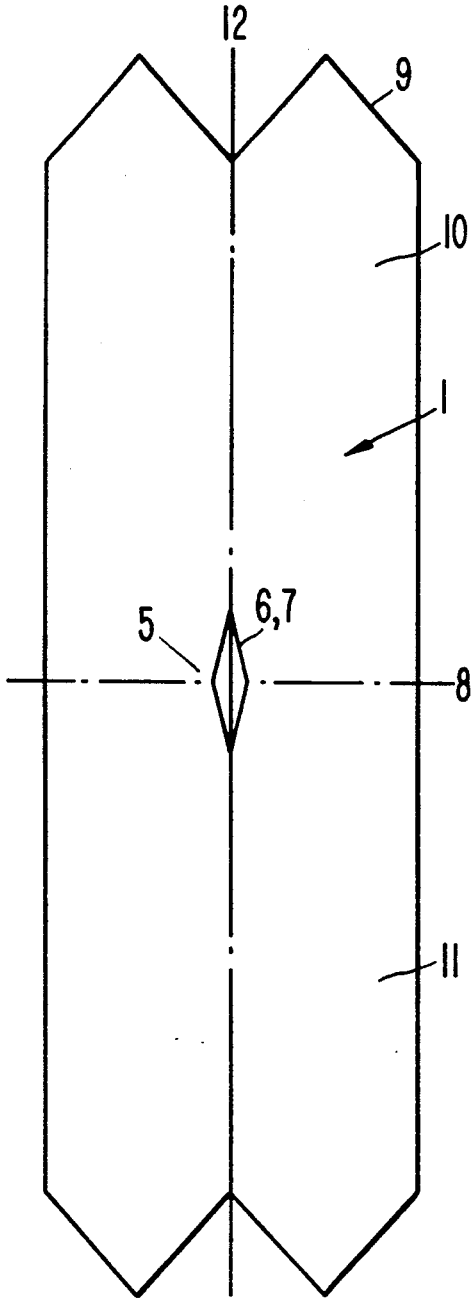
FIG. 1 is a view of a hose-like blank of round woven material of which the container shown in FIG. 4 is manufactured.

FIG. 1 illustrates a hose-like blank 1 for manufacture of a container according to the invention. The hose-like blank can be manufactured from an uncoated round woven fabric of polypropylene fibers or from a coated round woven fabric of polyethylene fibers or the like. The material used in various cases depends on the area of application and the properties of the material that the container is to carry. The diameter and length of the hose-like blank also can be varied and are dependent on the required volume and use.

As will be seen from FIG. 1, the hose-like blank 1 has at a middle portion 5 thereof two longitudinal slots 6 and 7 located diametrically opposite each other. These slots or openings can best be made when the hose-like blank is laid flat. The slots can be made by stamping or by making a cut. The slots or openings extend from a mid-length section or position 8 substantially equally the same length in both directions, but the length may vary, depending on, for instance, the volume and use of the container.

As shown in FIG. 1, opposite ends of the hose-like blank are cut so that the ends form pointed or sawtooth-shaped flaps 9. These flaps will form the base of the finished container. The construction of the base is not considered to be part of the present invention, it will therefore not be discussed further. However, it should be mentioned that the construction of the base is not restricted to the base described above or in NO U.S. Pat. No. 152,870. Various types of bases can be employed, such as a "cross base" or "inserted base". Depending on the application, a separate base can be used for the inner and outer sacks or a common base for both sacks.

Figure 2:
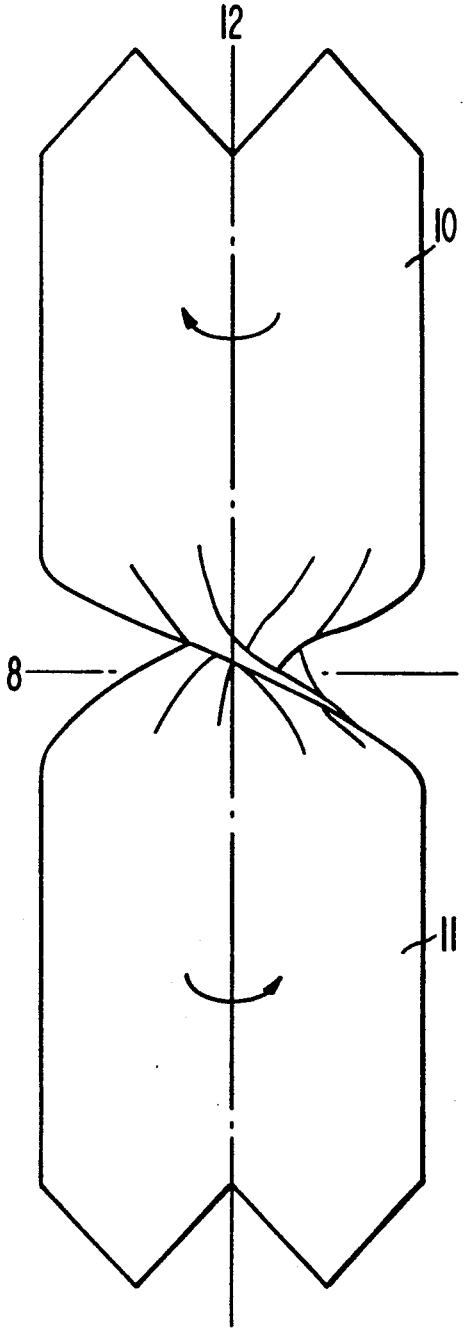
FIG. 2 is a similar view illustrating the rotation of the hose-like blank at a central section thereof.
Figure 3:
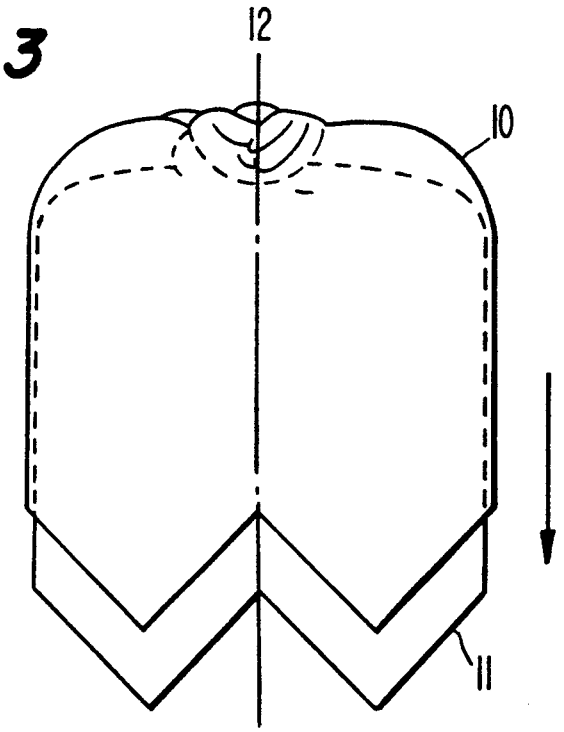
FIG. 3 is a similar view illustrating how one half of the length of the hose-like blank is thread on or fitted over the outside of the other half and thus forming inner and outer sacks.

FIGS. 2 and 3 illustrate various steps in the manufacture of the flexible container according to the present invention. Based on the hose-like blank illustrated in FIG. 1, one half length portion 10 of the blank is rotated relative to the other half length portion 11 around a longitudinal axis 12 of the blank, as shown in FIG. 2. The degree of rotation can vary, but will depend on the number of slots in the hose-like blank and also on the preferred lifting height. With two slots in the hose-like blank, the most preferred rotation will be approximately 180°.

The rotation occurs in the area of the mid-length section of the hose-like blank and is mainly absorbed by the blank material in the areas between the slots 6 and 7. The hose-like blank before rotation can be pressed together at the mid-length section 8. The material in the areas between the slots will when portion 10 of the hose-like blank is threaded on or pulled over the outside of the other portion 11 as illustrated in FIG. 3, form at least two integrated lifting loops 4, depending on how many slots are provided. This is shown in FIG. 4 where the flexible container according to the invention is illustrated.

The lifting loops 4 are direct extensions of the material of the walls of the inner and outer sacks and extend, due to the rotation, almost parallel from the outer sack 11' to the inner sack 10'. During lifting of the flexible container according to the invention the forces are distributed evenly and uniformly without stress concentration areas to the walls of inner sack 10' and outer sack 11'. This represents a great advantage of the invention and provides that the carrying capacity of the container can be increased without having to introduce new materials with fabric of higher strength or making any other reinforcements.

The above mentioned rotation also results in that the material that forms the lifting loop is twisted. The material is thus kept together, and the lifting loops extend parallelly and form one single lifting eye. The fact that the lifting loops are kept together also simplifies application or use of a lifting hook or the like when the container is lifted and transported. In should also be mentioned that the lifting loops can include a sleeve as described in NO U.S. Pat. No. 151,855.

Figure 4:
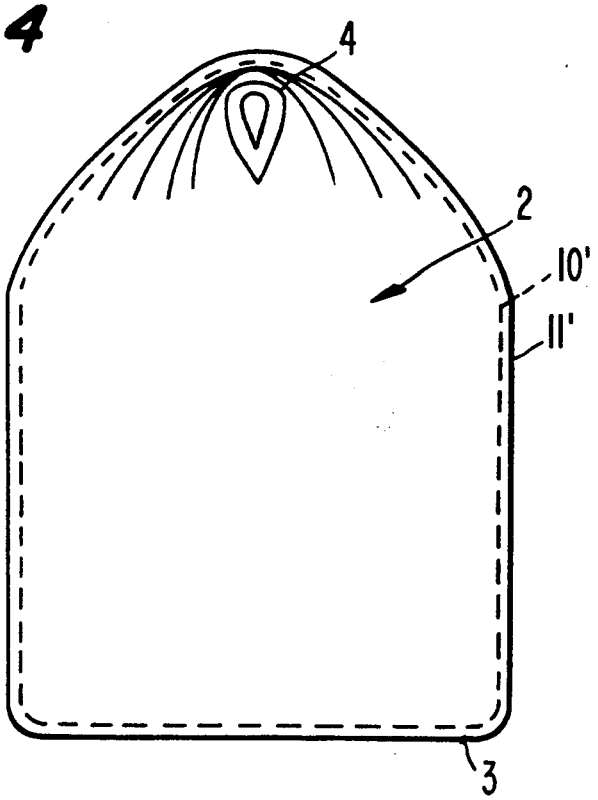
FIG. 4 is a similar view illustrating a flexible container according to the present invention.

FIG. 4 illustrates a finished container 2 according to present invention. As previously mentioned, the flexible container will be manufactured with a suitable common or separate base construction 3. If the container is manufactured with two separate bases, the base of the outer sack cannot be manufactured before turning one half of the hose-like blank inside out. However, the base of the inner sack can be manufactured either before or after this is done.

The flexible container can be manufactured according to the invention by forming in the hose-like blank two or more slots or openings separated by the same distance around the circumference of the hose-like blank. The finished flexible container will then have at least two integrated lifting loops both extending from one side of the inner sack and mainly diametrically to the opposite side of the outer sack. Examples with more than two lifting loops are not illustrated in the drawings. However, the method of manufacturing the container and its advantages are the same when there are more than two slots and two lifting loops.

By the present invention, there is provided a simple and easy method of manufacturing a double-walled flexible container. Further, all the steps of manufacturing the flexible container, i.e. cutting of the hose-like blank, rotation of the two half-length portions with respect to each other, turning one portion inside out, and the production of the base, can be achieved by use of simple manufacturing tools or equipment.

I claim:

1. In a method of manufacturing a flexible container for use in lifting, transportation and storage of bulk material, wherein said container is formed form an elongated hose-like blank of material having a longitudinal axis and a circumference by turning a first half-length portion of said blank inside out and fitting said first half-length portion over a second half-length portion of said blank thereby forming inner and outer sacks to be fitted with a base construction, the improvement comprising:

forming in a middle length portion of said elongated blank at least two axially extending openings spaced equally around said circumference; and rotating, in the area of said openings, said first half-length portion of said blank relative to said second half-length portion of said blank about said longitudinal axis, and thereby, after said turning said first half-length portion inside out and fitting said first half-length portion over said second half-length portion, forming areas of said material between said openings into at least two integrated lifting loops of rotated material.

2. The improvement claimed in claim 1, comprising flattening said elongated blank, and forming said openings by making at least one cut through said flattened blank.

3. The improvement claimed in claim 2, comprising making said cut to extend along said longitudinal axis.

4. The improvement claimed in claim 1, comprising forming said openings as elongated slots.

5. The improvement as claimed in claim 4, comprising forming said slots to be of equal length axially of said blank.

6. The improvement claimed in claim 4, comprising forming each said slot to extend in opposite directions equal length from a mid-length position of said blank.

7. The improvement claimed in claim 1, further comprising pressing flat said middle length portion of said blank prior to performing said rotating.

* * * * *